US005421326A

United States Patent [19]

Rankin et al.

[11] Patent Number: 5,421,326

[45] Date of Patent: Jun. 6, 1995

[54] HEAT RESISTANT SUIT WITH ACTIVE COOLING SYSTEM

[75] Inventors: R. Dewon Rankin; Roger D. Rankin, II, both of Buffalo; Curt N. Rankin, Tunas, all of Mo.

[73] Assignee: H.R.I. Incorporated, Buffalo, Mo.

[21] Appl. No.: 50,971

[22] Filed: Apr. 19, 1993

[51] Int. Cl.[6] ..... A62B 18/08

[52] U.S. Cl. ..... 128/201.19; 128/201.29; 128/201.21; 128/201.11; 600/19; 2/2; 2/69

[58] Field of Search ..... 2/2, 69, 79, 81, 84, 2/2.15, 2.11, 2.12, 2.13, 2.14; 128/201.29, 202.11, 201.21, 202.12, 205.26, 201.19; 600/19, 20, 21

[56] References Cited

U.S. PATENT DOCUMENTS

| | | | |
|---|---|---|---|
| 2,540,547 | 3/1947 | Rodert . | |
| 2,573,414 | 10/1951 | Dunn . | |
| 2,773,262 | 12/1956 | Brouha et al. . | |
| 2,966,684 | 1/1961 | Bonin . | |
| 3,113,320 | 12/1963 | Cherowbrier . | |
| 3,348,236 | 10/1967 | Copeland . | |
| 3,368,299 | 9/1969 | D'Amato . | |
| 3,452,812 | 7/1969 | Betts . | |
| 3,534,407 | 10/1970 | Barthlome . | |
| 3,710,395 | 1/1973 | Spano et al. . | |
| 3,751,727 | 8/1973 | Shepard et al. . | |
| 3,763,497 | 10/1973 | Leach . | |
| 4,172,454 | 10/1979 | Warncke et al. | 2/2.15 |
| 4,310,926 | 1/1982 | Maroist . | |
| 4,513,452 | 4/1985 | Rankin, Sr. et al. . | |
| 4,625,335 | 12/1986 | Vinai | 2/69 |
| 4,731,882 | 3/1988 | Ekman | 2/69 |
| 4,864,654 | 9/1989 | Schriver et al. | 2/81 |
| 4,876,746 | 10/1989 | Howie | 2/81 |
| 4,914,752 | 4/1990 | Hinson et al. . | |
| 5,007,112 | 4/1991 | Lewis, Jr. et al. . | |
| 5,014,355 | 5/1991 | Vollenweider, II | 2/79 |
| 5,088,115 | 2/1992 | Napolitano . | |
| 5,170,506 | 12/1992 | Lewis, Jr. et al. . | |

FOREIGN PATENT DOCUMENTS

| | | | |
|---|---|---|---|
| 48209 | 9/1982 | U.S.S.R. | 2/69 |

*Primary Examiner*—Clifford D. Crowder
*Assistant Examiner*—Gloria Hale
*Attorney, Agent, or Firm*—Litman, McMahon & Brown

[57] ABSTRACT

A heat resistant suit includes an inner garment designed to circulate cooling air against the wearer's body. The inner garment is connected to the cool air output of a vortex carried in a pocket in an outer, heat reflective coverall. A safety bottle is carried in another pocket of the coverall, with the safety bottle connected to a pressure valve which is also connected to an external source of breathing air. The vortex unit is connected to an external air compressor which can also be used to supply filtered, pressure regulated breathing air which is cooled by a second vortex unit. A safety harness is sewn into the coverall, with the safety harness connected to a pull ring attached to the rear of the coverall. The outer coverall is preferably constructed of KEVLAR cloth to which an external aluminum reflective coating is applied.

18 Claims, 2 Drawing Sheets

HEAT RESISTANT SUIT WITH ACTIVE COOLING SYSTEM

BACKGROUND OF THE INVENTION

1. Field of the Invention

This invention is directed to a heat resistant suit and more particularly to such a suit including a heat reflective, insulating coverall which forms an outer covering over an inner garment. The inner garment includes an active cooling air circulation system which is fed by a vortex unit integrated into the coverall.

2. Description of the Related Art

Steam generating boilers for electrical power generating plants can reach internal temperatures well in excess of 2000° Fahrenheit, and the surrounding system of supply pipes and conduits routinely reach temperatures of 500° fahrenheit and greater. In the past, when the boiler or surrounding pipe networks needed maintenance or repair, the boiler would be shut down entirely and cooled to a temperature in which workmen could safely operate. Workers could then enter the boiler and/or the surrounding pipe network to perform the needed repairs. The time needed to cool a boiler from the 2000° operating temperature to a temperature safe for workmen to enter can be as long as 24 hours. The total time period from initial shutdown to subsequent start-up after repair can thus involve two or more days even when the repairs themselves may take only a matter of only a few hours to perform. The cost of bringing a steam driven generator off-line in a major power plant can cost upwards of one hundred thousand dollars per day.

When the boilers themselves need repair, there is no choice but to shut them down and wait for them to cool. Previously, boilers were cooled to an inside temperature of 150° Fahrenheit or less to permit workmen to operate inside for extended periods. Furthermore, previously, when the surrounding pipe network is in need of repair, it was standard procedure for the boiler to be shut down so that the pipes can be cooled.

Thus, it would be desirable to be able to perform repair work inside the boilers without requiring them to be cooled to 150° or, alternatively, repair work in the surrounding pipe network while the boiler is still operating, albeit at a reduced combustion level. As previously mentioned, this can necessitate the workmen operating in environments with temperatures in excess of 500° Fahrenheit. In order to work at such a temperature, the workmen must be protected by specially designed, heat resistant suits which often include an active body cooling capability. Furthermore, workmen in such environments are frequently exposed to noxious or poisonous gasses, so that an artificial breathing apparatus must be used as well.

Numerous prior attempts have been made to design a heat resistant suit for use in high temperature environments. One relatively early example of a heat resistant suit with a cooling capability is that of U.S. Pat. No. 2,573,414 to K. Dunn. The Dunn patent teaches an aluminized coverall which reflects heat, and which incorporates an internal cooling manifold through which cooling air is circulated. Heat resistant suits of the type disclosed by Dunn allowed workers limited protection from elevated temperatures for a short time period. However, to be cost effective, workmen must preferably be capable of continuous work for periods of 30 minutes or longer. Such suits were generally not capable of permitting continuous exposure to temperatures in excess of 150° Fahrenheit for such time periods.

Recent advances in fabric technology and experience with cooling system designs have yielded heat resistant suits with greatly enhanced capabilities. For example, U.S. Pat. No. 4,513,452 to P. Phillip Rankin, Sr. et al. discloses a heat resistant suit with an internal vest through which refrigerated air is circulated and directed against the wearer's body. The vest is covered by a suit including a coat and a trousers portion, both of which are made of a heat resistant material. A pipe network is attached externally to the vest, but inside the outer suit to carry the refrigerated air into the leg and feet portions and the arm and hand portions of the suit. A safety bottle is worn about a belt worn inside the suit to provide breathing air for a limited time should an external air compressor fail. Breathing air from the external compressor or the safety bottle is directed to a face mask into which a radio microphone and speaker are built. A safety harness is partially built into the coat and trousers, with these separate sections of the harness being connected together after the suit is put on.

The suit disclosed in the Rankin patent represented a marked improvement over earlier prior art suits in that it allowed a workmen to work continuously for extended periods at the elevated temperatures mentioned earlier. However, a number of disadvantages resulted from the suit construction. To put the suit on, a wearer must first don the cooling vest, then put on the cooling pipe networks, which must be connected to the vest and to the external compressor. Next the belt containing the safety bottle must be put on along with the breathing mask. The boots, trousers, helmet and gloves must then be put on in a preset order and the coat cinched about the trousers. Next the separate safety harness portions must be connected together. The entire process can take several minutes and often requires a second workman to help the wearer in donning the suit. Furthermore, a separate refrigeration source is required which must be positioned outside of the high temperature work area to refrigerate the circulated cooling air and/or the breathing air. The Rankin et al. U.S. Pat. No. 4,513,452 is expressly incorporated herein by reference.

Another example of a temperature regulated garment is U.S. Pat. No. 4,914,752 to Hinson et al., which discloses a multi-layer cooling suit designed to keep toxic substances from reaching the wearer. An externally worn vortex unit attached to an external compressor provides cooling air to the interior of the suit. The Hinson suit is not designed for continuous use at the extreme temperatures found in a boiler environment. The Hinson patent includes a discussion and illustration of the operation of a typical vortex cooling unit, and, accordingly, U.S. Pat. No. 4,914,752 is also expressly incorporated herein by reference.

It is clear then, that a need still exists for a heat resistant suit equipped for continuous operation at extreme temperatures such as those found in industrial boilers and environs. Such a suit should preferably be equipped with a vortex unit instead of an external refrigeration unit for internal cooling of the wearer. The suit should preferably include a one-piece coverall outer garment and an inner cooling garment adapted to circulate cooling air to the wearer. The outer garment should include dedicated and easily accessible storage locations for the vortex tube, a safety bottle, a radio, etc. The suit may be equipped such that breathing air is drawn from the same flow of compressed air as the cooling air and a separate vortex unit can be provided to cool the breathing air. Finally, since workmen in such environments must be capable of being quickly pulled out of the work areas in emergency situations, a safety harness should be integrated with the suit to which a cable can be quickly connected to pull the workman free.

SUMMARY OF THE INVENTION

In the practice of the present invention, a heat resistant suit includes an inner garment designed to circulate cooling air against the wearer's body. The inner garment is connected to the cold air output of a vortex carried in a dedicated pocket in an outer, heat resistant coverall. A safety bottle is carried in another pocket of the coverall, with the safety bottle connected to a pressure valve which is also connected to an external source of breathing air. The vortex unit is connected to an external air compressor which can also be used to supply filtered, pressure regulated breathing air which is cooled by a second vortex unit. The safety bottle pocket and the vortex pockets each include sealed grommets providing access to the interior of the coverall for air hoses. The cooled breathing air is supplied to a mask positioned within a hood which is attachable to the coverall. The coverall includes a one-piece zipper which is covered by a snapped safety flap. A safety harness is sewn into the coverall, with the safety harness connected to a pull ring attached to the rear of the coverall. The outer coverall is preferably constructed of a high tensile strength aromatic polyamide fiber such as KEVLAR cloth or a similar material to which an external aluminum reflective coating is applied. The safety strap is made of high strength aromatic polyamide fiber such as KEVLAR fabric sewn into the garment with a high tensile strength aromatic polyamide fiber such as KEVLAR thread.

OBJECTS AND ADVANTAGES OF THE INVENTION

The principle objects and advantages of the present invention include: to provide an improved heat resistant suit capable of sustaining a wearer's body temperature in a safe range while the wearer is working in temperatures of 500° Fahrenheit or greater; to provide such a suit in which an inner garment is adapted to circulate cooling air against the wearer's body; to provide such a suit in which an external heat reflective one-piece coverall entirely covers the wearer's body; to provide such a suit in which a vortex unit, which is stored in a dedicated storage location within the outer coverall, has an input connected to an external air compressor and a cool air output connected to the inner cooling garment; to provide such a suit in which a safety harness is integrally sewn into the outer coverall; to provide such a suit in which the coverall includes a one-piece zipper which is covered by a safety flap which can be snapped over the zipper; to provide such a suit in which a second vortex unit is used to cool breathing air supplied from the external compressor or another source; to provide such a suit which is of a simpler construction and which is much easier to put on and take off than prior art heat resistant suits; and to provide such a suit which is particularly well suited for its intended purpose.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE INVENTION

I. Introduction and Environment

Figure 1:
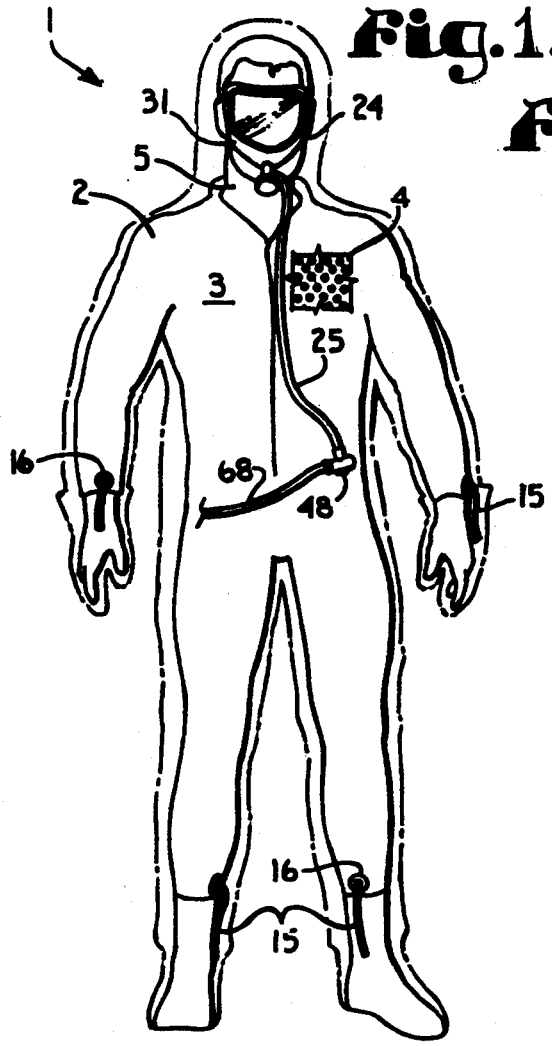
FIG. 1 is a perspective view of an active cooling inner garment shown on a wearer, with an outer, heat resistant garment shown in outline over the inner garment.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Certain terminology will be used in the following description for convenience in reference only and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the embodiment being described and designated parts thereof. Said terminology will include the words specifically mentioned, derivatives thereof and words of a similar import.

Figure 2:
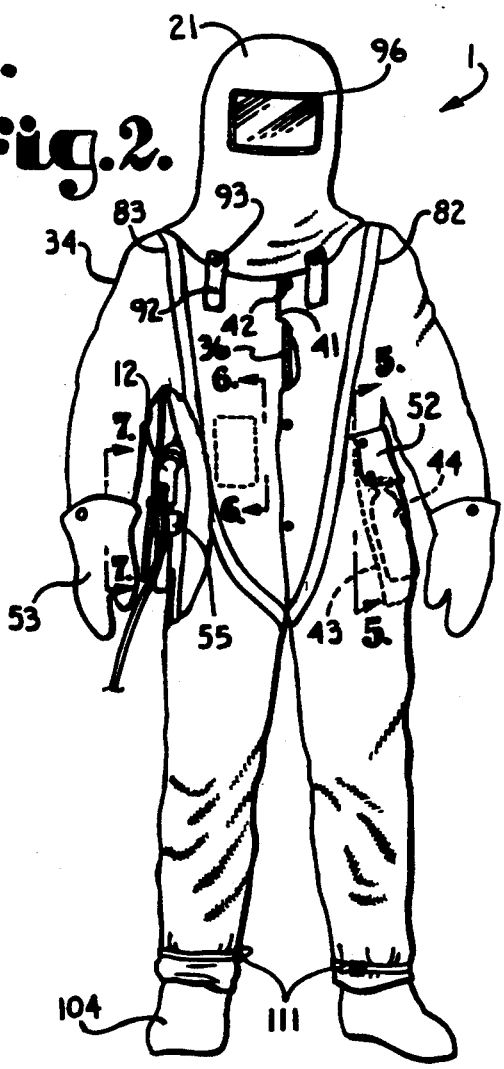
FIG. 2 is a perspective view of the outer, heat resistant garment on the wearer, with portions broken away to illustrate various features thereof.
Figure 3:
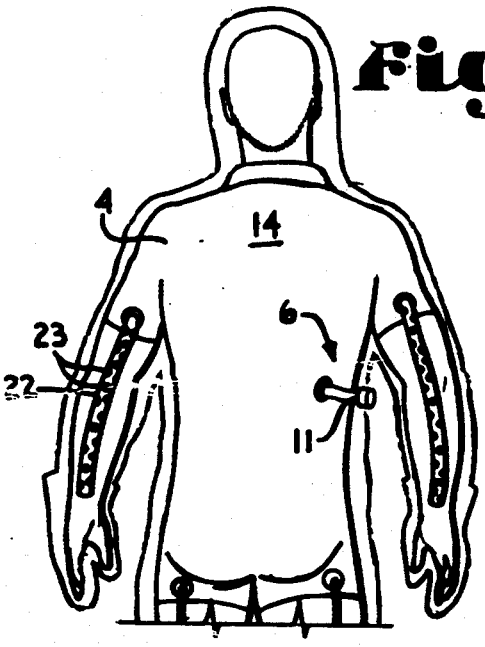
FIG. 3 is a fragmentary, rear elevational view of a second embodiment of the active cooling inner garment, with the outer coverall again shown in outline form.
Figure 8:
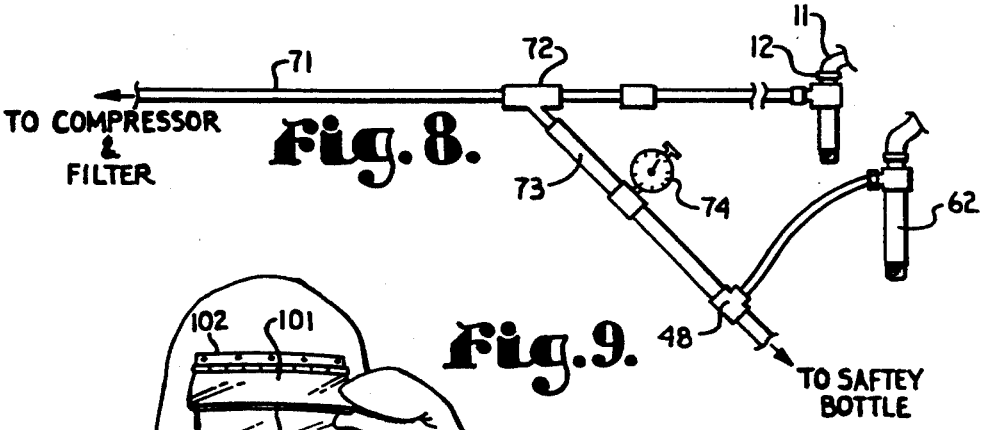
FIG. 8 is an enlarged, fragmentary view of a combination breathing and cooling supply tube, with the breathing tube split off via a Y connector and leading to a regulator and a cooling vortex.

Referring to the drawings in more detail the reference numeral 1 in FIGS. 1 and 2 generally designates a heat resistant suit in accordance with the present invention. Referring to FIG. 1, the heat resistant suit 1 includes an inner, body contacting garment 2, shown here as a full body suit. The body suit 2 is constructed of two separate material layers with an air impermeable outer layer 3 partially cut away to reveal a perforated inner layer 4. The layers 3 and 4 are sewn together at the periphery of the suit 2, with the suit 2 being semi-inflatable when cooling air is introduced to a wearer 5 via a cooling air inlet 6. The inlet 6 includes a quick-release connector 11 which is connectable to a cool air outlet 12 of a cooling air vortex unit 13 (FIG. 8). The connector 11 is shown in FIG. 3 connected through the outer layer 4 of a second embodiment 14 of an inner garment, where the garment 14 constitutes a torso covering vest. The vest 14 is of a similar construction as the suit 2, with an air impermeable outer layer 3 and a perforated inner layer 4 (not shown).

In the body suit 2, a number of cooling air outlet hoses 15 are connected to the legs and arms of the suit 2, and are adapted to direct cooling air from the suit 2 to the wearer's extremities such as his hands and feet. The hoses 15 are connected through the outer layer 3 of the suit 2 via a like plurality of grommets 16. While four hoses 15 are illustrated, it should be noted that any number can be used, including additional hoses directing cooling air into a hood 21. The vest 14 includes a number of similar cooling hoses 22, which are longer and which include perforations 23 to cool the arms and legs of the wearer as well. The body suit 2 is designed to be somewhat snugger fitting, when inflated, than the vest 14 to permit relatively free movement of the wearer. For example, the maximum separation of layers 3 and 4 in the body suit 2 is approximately 3/16" to ⅜" while the maximum inflation of corresponding layers 3 and 4 in the vest 14 is approximately ⅜" to ½".

Figure 6:
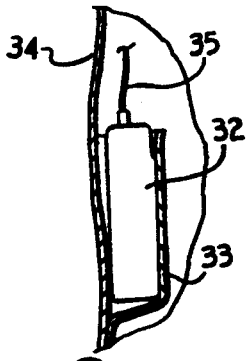
FIG. 6 is an enlarged, fragmentary cross-sectional view of a radio and pocket in the outer coverall, taken along line 6—6 of FIG. 2.
Figure 7:
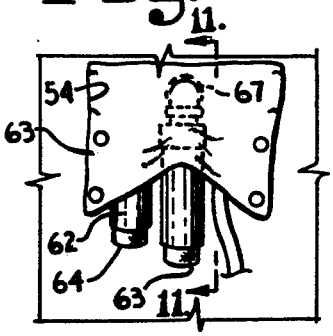
FIG. 7 is an enlarged, fragmentary side elevational view of a side flap in the outer coverall holding two cooling vortex units, with the view taken along line 7—7 of FIG. 2.

Since workmen requiring cooling suits often need to operate in environments with noxious gasses, a breathing mask 24 is provided, with breathing air supplied via a breathing hose 25. An optional breathing air vortex 31 can be provided to cool the breathing air supplied to the mask 24. The mask 24 also includes a combination bone microphone and speaker 31 connected to a voice activated radio 32 (FIG. 6) positioned in an inwardly directed pocket 33 in an outer coverall 34 for reliable, hands free communication with support crews. An electrical cable 35 is provided to connect the radio 32 and the microphone 31.

The outer, one-piece coverall 34 is constructed of an aluminized, waterproof and heat resistant fabric, such as aluminized aromatic polyamide fiber such as KEVLAR or the like. A one-piece metal zipper 36 closes the coverall 34 and a safety flap 41, provided with snaps 42 covers the zipper 36 to prevent the wearer from being directly exposed to high temperature should the zipper 36 fail. In addition to the radio pocket 33, the coverall 34 includes a breathing safety bottle pocket 43 sized and positioned to accommodate a safety bottle 44 secured by a strap 45. The pocket 43 includes an inwardly opening grommet seal 46 to permit a breathing line 47 to enter the coverall 34, and connect to one side of a pressure valve 48. A large, quick-release flap 52 permits the wearer 5, even while wearing mittens 53, to quickly access the bottle 44 in the event of an emergency, such as the cut-off of an outside air compressor (not shown).

A vortex pocket 54 in the coverall 34 is positioned opposite the safety bottle pocket 43, and a pair of securing straps 55 secure the cooling air vortex unit 13 and a breathing air vortex unit 62 to the coverall 34. A flap 63 covers most of the vortex units 13 and 62, leaving heat radiators 63 and 64, respectively, exposed. The vortex units 13 and 62, using a cyclonic internal action, exhaust hot air out the radiators 63 and 64, while extracting cooled air and directing it out a top, cool air outlets 12 and 66, respectively (FIG. 8). The pocket 54 thus opens outward to allow the radiators 63 and 64 to exhaust hot air outside the coverall 34 and includes inwardly facing grommets 67 to allow breathing tube 68 to enter the coverall 34 and the quick release connector 11 to be connected directly to the cool air outlet 12.

Referring to FIG. 8, in one embodiment, both cooling air and breathing air are supplied via a single compressor and filter (not shown) and a single feed hose 71. A splitting connector, such as a Y connector 72, which can be positioned within the pocket 54, connects a breathing air hose 73 to a regulator 74. The regulator 74 is necessary since proper operation of the cooling air vortex 13 requires compressed air pressurized to at least 85 psig and preferably 100+psig while breathing air can be a maximum of 75 psig. Breathing air from the regulator 74 is applied to the breathing air vortex 62, which is operative to cool the air for breathing purposes. By separately cooling the breathing air, the internal temperature of the wearer 6 can be markedly reduced, greatly increasing the comfort and the operating longevity of the wearer 6.

A safety harness, generally indicated as 81, includes a pair of continuous straps 82 and 83 sewn into the coverall 34. The straps 82 and 83 extend over opposite shoulders of the wearer 6, respectively, and loop between the legs to provide a reliable support for a safety ring 84, sewn into a ring strap 85, which is also sewn into the coverall 34 and into each of the straps 82 and 83. Thus equipped, the wearer 6, should he fall or be rendered unconscious or otherwise unable to move, can be quickly connected to a retrieval line (not shown) and pulled out of danger.

Figure 4:
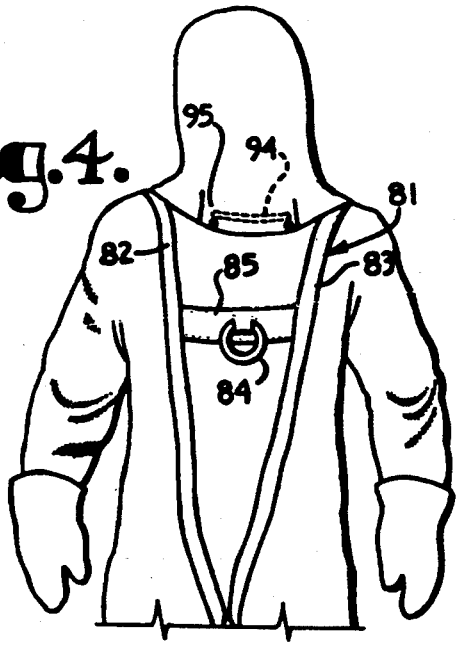
FIG. 4 is a fragmentary, rear elevational view of the outer heat resistant coverall, showing the attachment of the hood to the garment and a safety ring attached to a safety harness.
Figure 5:
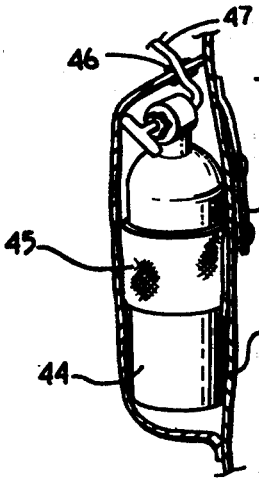
FIG. 5 is an enlarged, fragmentary cross-sectional view of a safety bottle and pocket in the outer coverall, taken along line 5—5 of FIG. 2.

The hood 21, which can be constructed of similar material to the coverall 34, is worn over the wearer's head and secured to the coverall 34 via a pair of straps 92 sewn into the coverall 34 and snaps 93. In addition, a zipper 94, shown in phantom lines in FIG. 4, connects the hood 91 to the coverall 34 and a safety flap 95 is snapped over the zipper 94. A transparent or tinted eye shield 96 is provided within the hood 21.

Figure 9:
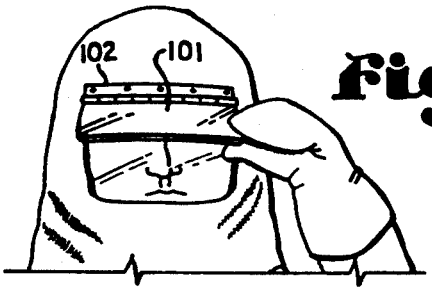
FIG. 9 is a hood with a hinged welding shield selectively positionable over a built-in lens in the hood.
Figure 11:
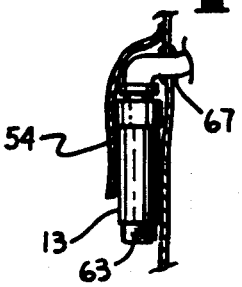
FIG. 11 is an enlarged, fragmentary cross-sectional view of the vortex pocket, taken along line 11—11 of FIG. 7.

FIG. 9 illustrates an optional welding visor 101 hingedly attached to the eye shield 96 in the hood 91 via a hinge 102. The welding visor 101 can be flipped down over the shield 96 to darken the wearer's field of vision while welding. Unlike prior art welding visors, which were typically about 2" by 3", the visor 101 is approximately 5" by 6", which gives the wearer 6 a relatively unobstructed field of view when the welding visor 101 is flipped up.

The gloves or mittens 103 and a pair of protective boots 104 are part of the suit 1, and the gloves 103 are attached to the coverall 34 via snaps 105. The legs of the coverall 34 are cinched about the boots 104 via a pair of cinch straps 111.

Figure 10:
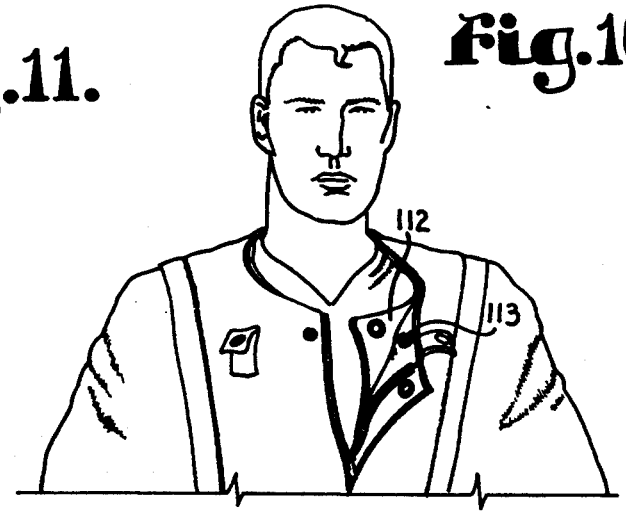
FIG. 10 is a fragmentary, perspective view of the outer coverall, illustrating a removable, waterproof inner lining.

Referring to FIG. 10, a thermally insulated and waterproof inner liner 112 is removably attached to the coverall 34 via a plurality of snaps 113. In work areas with restricted space or access openings and with relatively low working temperatures, such as 250° Fahrenheit, for example, the liner 112 can be snapped out prior to putting on the coverall 34 to allow the wearer 6 to present a slimmer profile.

In a preferred embodiment of the suit 1, the coverall 34 is constructed of 10 oz. aromatic polyamide fiber such as KEVLAR cloth with one side aluminized. As an alternative, the coverall 34 can be constructed of an herringbone glass weave fabric aluminized on one side, as manufactured by FYREPEL. The safety harness straps 82 and 83 are constructed of 10,000 lb. strength aromatic polyamide fiber such as KEVLAR and the ring 84 is made of heat treated steel. The cooling vortex unit 13 and the breathing air vortex unit 62 are Vortec units produced by Vortec Corporation. The entire coverall 34, including straps 82 and 83, safety flaps 41 and 95, and pockets 43 and 63 are sewn with heat resistant aromatic polyamide fiber such as KEVLAR thread. The safety flap 41 extends approximately 3" past the zipper 36. The inner garments 2 and 14 are constructed of heavy gauge plastic. With this construction, the suit 1 is capable of sustaining normal body temperature for the wearer 5 at ambient temperatures of 700° Fahrenheit for 30 minutes, and at ambient temperatures of 2000° Fahrenheit for up to 10 minutes.

It is to be understood that while certain forms of the present invention have been illustrated and described herein, it is not to be limited to the specific forms or arrangement of parts described and shown.

What is claimed and desired to be secured by Letters Patent is as follows:

1. A heat resistant suit for actively cooling a wearer's body in a high temperature environment, comprising:

(a) a body contacting inner garment including an active body cooling means;

(b) an outer, one-piece heat reflective coverall;

(c) a body cooling vortex unit including a compressed air input, a hot air output, and a cool air output;

(d) a vortex pocket of said coverall adapted to hold said body cooling vortex unit in a position in which cooled air from said vortex unit is directed to said body cooling means while hot air from said hot air output is directed outside said coverall;

(e) a safety air bottle positioned in a safety bottle pocket of said coverall, said safety bottle pocket also being isolated from the interior of said coverall; and (f) a quick release cover flap positioned over the safety bottle pocket on the outside of said coverall, said quick release flap allowing said wearer to quickly access said safety bottle.

2. A heat resistant suit for actively cooling a wearer's body in a high temperature environment, comprising:

(a) a body contacting inner garment including an active body cooling means;

(b) an outer, one-piece heat reflective coverall;

(c) a body cooling vortex unit including a compressed air input, a hot air output, and a cool air output;

(d) a vortex pocket of said coverall adapted to hold said body cooling vortex unit in a position in which cooled air from said vortex unit is directed to said body cooling means while hot air from said hot air output is directed outside said coverall, said vortex pocket being isolated from the interior of said coverall;

(e) a safety air bottle positioned in a safety bottle pocket of said coverall, said safety bottle pocket also being isolated from the interior of said coverall;

(f) a quick release cover flap positioned over the safety bottle pocket on the outside of said coverall, said quick release flap allowing said wearer to quickly access said safety bottle;

(g) a breathing mask fitted to said wearer, said mask including a bone microphone and speaker;

(h) a two way radio positioned in an interior pocket of said coverall, said radio being connected to said bone microphone and speaker; and (i) a safety harness sewn into the outside of said coverall, said safety harness including a pair of continuous high tensile strength straps with each said continuous strap extending over a corresponding shoulder of said wearer and extending between the wearer's legs, with each said strap sewn to the coverall, and a safety ring attached to an additional strap sewn to the coverall and to each of said continuous straps.

3. A heat resistant suit as in claim 2, and further comprising:

(a) a removable, insulated, waterproof lining selectively attachable to the inside of said coverall.

4. A heat resistant suit as in claim 3, wherein:

(a) said coverall is constructed of relatively lightweight, waterproof high tensile strength aromatic polyamide fiber cloth with an aluminized outer coating.

5. A heat resistant suit as in claim 2, wherein:

(a) said inner garment comprises a body suit with an outer, air impermeable layer and an inner layer including a plurality of perforations contacting the wearer's skin, said inner layer being separated from said outer layer, said outer and inner layers being connected at the peripheries thereof;

(b) a plurality of cooling hoses, each said hose connected through said outer layer and connecting the separation between layers in said body suit to a respective one of the wearer's extremities; and (c) said active cooling means comprises an external air compressor supplying compressed air to the input of said cooling vortex unit, said cool air output from said vortex unit being connectable to a connector which communicates from said vortex pocket of said body suit to said separation between layers in said body suit; whereby (d) said body suit is partially inflated via said cooling air, said cooling air being directed against the wearer's body via said perforations and to the wearer's extremities via said cooling hoses.

6. A heat resistant suit as in claim 2, wherein:

(a) said inner garment comprises a vest with an outer, air impermeable layer and an inner layer, including a plurality of perforations, contacting the wearer's skin, said inner layer being separated from said outer layer, said outer and inner layers being connected at the peripheries thereof;

(b) a plurality of cooling hoses, each said hose connected through said outer layer and connecting the separation between layers in said body suit to a respective one of the wearer's extremities, each said hose including a plurality of perforations extending along its length; and (c) said active cooling means comprises an external air compressor supplying compressed air to the input of said cooling vortex unit, said cool air output from said vortex unit being connectable to a connector which communicates from said vortex pocket of said body suit to said separation between layers in said body suit; whereby (d) said vest is partially inflated via said cooling air, said cooling air being directed against the wearer's torso via said perforations and to the wearer's arms, legs and extremities via said cooling hoses.

7. A heat resistant suit as in claim 2, and further comprising:

(a) an external source of breathing air connected to an input of a breathing air cooling vortex unit, said breathing air cooling vortex unit also being positioned in said vortex pocket of said coverall which pocket is adapted to hold said breathing air cooling vortex unit in a position in which cooled air from said breathing air cooling vortex is directed to said breathing mask while hot air from said breathing air cooling vortex is directed outside said coverall.

8. A heat resistant suit for actively cooling a wearer's body in a high temperature environment, comprising:

(a) a body contacting inner garment including an active body cooling means;

(b) an outer, one-piece heat reflective coverall;

(c) a body cooling vortex unit including a compressed air input, a hot air output, and a cool air output;

(d) a source of compressed cooling air;

(e) a vortex pocket of said coverall adapted to hold said body cooling vortex unit in a position in which cooled air from said vortex unit is directed to said body cooling means while hot air from said hot air output is directed outside said coverall, said vortex pocket being isolated from the interior of said coverall;

(f) a safety air bottle positioned in a safety bottle pocket of said coverall, said safety bottle pocket also being isolated from the interior of said coverall;

(g) a quick release cover flap positioned over the safety bottle pocket on the outside of said coverall, said quick release flap allowing said wearer to quickly access said safety bottle;

(h) a breathing mask fitted to said wearer, said mask including a bone microphone and speaker;

(i) a two way radio positioned in an interior pocket of said coverall, said radio being connected to said bone microphone and speaker;

(j) a safety harness sewn into the outside of said coverall, said safety harness including a pair of continuous high tensile strength straps with each said strap extending over a corresponding shoulder of said wearer and extending between the wearer's legs, with each said strap sewn to the coverall, and a safety ring attached to an additional strap sewn to the coverall and to each of said continuous straps;

(k) an external source of breathing air connected to an input of a breathing air cooling vortex unit, said breathing air cooling vortex unit also being positioned in said vortex pocket of said coverall which pocket is adapted to hold said breathing air cooling vortex unit in a position in which cooled air from said breathing air cooling vortex is directed to said breathing mask while hot air from said breathing air cooling vortex is directed outside said coverall.

9. A heat resistant suit as in claim 8, wherein:

(a) said compressed air cooling source also provides said external source of breathing air.

10. A heat resistant suit as in claim 8, wherein:

(a) said inner garment comprises a body suit with an outer, air impermeable layer and an inner layer including a plurality of perforations contacting the wearer's skin, said inner layer being separated from said outer layer, said outer and inner layers being connected at the peripheries thereof;

(b) a plurality of cooling hoses, each said hose connected through said outer layer and connecting the separation between layers in said body suit to a respective one of the wearer's extremities; and (c) said active cooling means comprises an external air compressor supplying compressed air to the input of said cooling vortex unit, said cool air output from said vortex unit being connectable to a connector which communicates from said vortex pocket of said body suit to said separation between layers in said body suit; whereby (d) said body suit is partially inflated via said cooling air, said cooling air being directed against the wearer's body via said perforations and to the wearer's extremities via said cooling hoses.

11. A heat resistant suit as in claim 8, wherein:

(a) said inner garment comprises a vest with an outer, air impermeable layer and an inner layer, including a plurality of perforations, contacting the wearer's skin, said inner layer being separated from said outer layer, said outer and inner layers being connected at the peripheries thereof;

(b) a plurality of cooling hoses, each said hose connected through said outer layer and connecting the separation between layers in said body suit to a respective one of the wearer's extremities, each said hose including a plurality of perforations extending along its length; and (c) said active cooling means comprises an external air compressor supplying compressed air to the input of said cooling vortex unit, said cool air output from said vortex unit being connectable to a connector which communicates from said vortex pocket of said body suit to said separation between layers in said body suit; whereby (d) said vest is partially inflated via said cooling air, said cooling air being directed against the wearer's torso via said perforations and to the wearer's extremities, arms and legs via said cooling hoses.

12. A heat resistant suit for actively cooling a wearer's body in a high temperature environment, comprising:

(a) a body contacting inner garment including an active body cooling means;

(b) an outer, one-piece heat reflective coverall;

(c) a body cooling vortex unit including a compressed air input, a hot air output, and a cool air output;

(d) a vortex pocket of said coverall adapted to hold said body cooling vortex unit in a position in which cooled air from said vortex unit is directed to said body cooling means while hot air from said hot air output is directed outside said coverall;

(e) a breathing mask fitted to said wearer, said mask including a bone microphone and speaker; and (f) a two way radio positioned in an interior pocket of said coverall, said radio being connected to said bone microphone and speaker.

13. A heat resistant suit for actively cooling a wearer's body in a high temperature environment, comprising:

(a) a body contacting inner garment including an active body cooling means;
(b) an outer, one-piece heat reflective coverall;
(c) a body cooling vortex unit including a compressed air input, a hot air output, and a cool air output;
(d) a vortex pocket of said coverall adapted to hold said body cooling vortex unit in a position in which cooled air from said vortex unit is directed to said body cooling means while hot air from said hot air output is directed outside said coverall; and
(e) a removable, insulated, waterproof lining selectively attachable to the inside of said coverall.

14. A heat resistant suit as in claim 13, and further comprising:
(a) a safety harness sewn into the outside of said coverall, said safety harness including a pair of continuous high tensile strength straps with each said strap extending over a corresponding shoulder of said wearer and extending between the wearer's legs, with each said continuous strap sewn to the coverall, and a safety ring attached to an additional strap sewn to the coverall and to each of said continuous straps.

15. A heat resistant suit as in claim 13, wherein:
(a) said coverall is constructed of relatively lightweight, waterproof high tensile strength aromatic polyamide fiber cloth with an aluminized outer coating.

16. A heat resistant suit as in claim 13, and further comprising:
(a) a breathing mask fitted to said wearer; and
(b) an external source of breathing air connected to an input of a breathing air cooling vortex unit, said breathing air cooling vortex unit also being positioned in said vortex pocket of said coverall which pocket is adapted to hold said breathing air cooling vortex unit in a position in which cooled air from said breathing air cooling vortex is directed to said breathing mask while hot air from said breathing air cooling vortex is directed outside said coverall.

17. A heat resistant suit for actively cooling a wearer's body in a high temperature environment, comprising:
(a) a body contacting inner garment including an active body cooling means, said inner garment comprising a body suit with an outer, air impermeable layer and an inner layer including a plurality of perforations contacting the wearer's skin, said inner layer being separated from said outer layer, said outer and inner layers being connected at the peripheries thereof;
(b) an outer, one-piece heat reflective coverall;
(c) a body cooling vortex unit including a compressed air input, a hot air output, and a cool air output;
(d) a vortex pocket of said coverall adapted to hold said body cooling vortex unit in a position in which cooled air from said vortex unit is directed to said body cooling means while hot air from said hot air output is directed outside said coverall;
(e) a plurality of cooling hoses, each said hose connected through said outer layer of said inner garment and connecting the separation between layers in said body suit to a respective one of the wearer's extremities;
(f) said active cooling means comprising an external air compressor supplying compressed air to the input of said cooling vortex unit, said cool air output from said vortex unit being connectable to a connector which communicates from said vortex pocket of said body suit to said separation between layers in said body suit; whereby
(e) said body suit is partially inflated via said cooling air, said cooling air being directed against the wearer's body via said perforations and to the wearer's extremities via said cooling hoses.

18. A heat resistant suit for actively cooling a wearer's body in a high temperature environment, comprising:
(a) a body contacting inner garment including an active body cooling means, said inner garment comprising a vest with an outer, air impermeable layer and an inner layer, including a plurality of perforations, contacting the wearer's skin, said inner layer being separated from said outer layer, said outer and inner layers being connected at the peripheries thereof;
(b) an outer, one-piece heat reflective coverall;
(c) a body cooling vortex unit including a compressed air input, a hot air output, and a cool air output;
(d) a vortex pocket of said coverall adapted to hold said body cooling vortex unit in a position in which cooled air from said vortex unit is directed to said body cooling means while hot air from said hot air output is directed outside said coverall;
(e) a plurality of cooling hoses, each said hose connected through said outer layer of said inner garment and connecting the separation between layers in said body suit to a respective one of the wearer's extremities, each said hose including a plurality of perforations extending along its length;
(f) said active cooling means comprising an external air compressor supplying compressed air to the input of said cooling vortex unit, said cool air output from said vortex unit being connectable to a connector which communicates from said vortex pocket of said body suit to said separation between layers in said body suit; whereby
(g) said vest is partially inflated via said cooling air, said cooling air being directed against the wearer's torso via said perforations and to the wearer's extremities, arms and legs via said cooling hoses.

* * * * *